US009458575B2

(12) United States Patent
Walter et al.

(10) Patent No.: US 9,458,575 B2
(45) Date of Patent: Oct. 4, 2016

(54) RAIL ATTACHMENT SYSTEM FOR JUNCTION AREAS

(71) Applicant: SCHWIHAG AG, Tägerwilen (CH)

(72) Inventors: Daniel Walter, Kaltbrunn/Allensbach (DE); Stefan Lienhard, Constance (DE); Erik Danneberg, Taegerwilen (CH); Roland Buda, Radolfzell am Bodensee (DE)

(73) Assignee: SCHWIHAG AG, Taegerwilen (CH)

( * ) Notice: Subject to any disclaimer, the term of this patent is extended or adjusted under 35 U.S.C. 154(b) by 0 days.

(21) Appl. No.: 14/410,451

(22) PCT Filed: Jul. 22, 2013

(86) PCT No.: PCT/EP2013/065413

§ 371 (c)(1),
(2) Date: Dec. 22, 2014

(87) PCT Pub. No.: WO2014/016246

PCT Pub. Date: Jan. 30, 2014

(65) Prior Publication Data

US 2015/0136865 A1 May 21, 2015

(30) Foreign Application Priority Data

Jul. 23, 2012 (DE) ..... 10 2012 014 500

(51) Int. Cl.
*E01B 9/00* (2006.01)
*E01B 9/34* (2006.01)
(Continued)

(52) U.S. Cl.
CPC ..... *E01B 9/34* (2013.01); *E01B 2/003* (2013.01); *E01B 9/483* (2013.01); *E01B 9/60* (2013.01); *E01B 9/68* (2013.01)

(58) Field of Classification Search
CPC ..... E01B 9/38; E01B 9/34; E01B 9/483; E01B 9/60; E01B 9/68; E01B 2/003
See application file for complete search history.

(56) References Cited

U.S. PATENT DOCUMENTS 4,907,740 A * 3/1990 Oberweiler ..... E01B 9/303 238/283
6,257,495 B1 * 7/2001 Eisenberg ..... E01B 9/303 238/349

(Continued)

FOREIGN PATENT DOCUMENTS

CH WO 2014016246 A1 * 1/2014 ..... E01B 2/003
DE 2600416 A 3/1977

(Continued)

*Primary Examiner* — Jason C Smith
(74) *Attorney, Agent, or Firm* — Andrew Wilford

(57) ABSTRACT

The invention relates to a rail attachment system (1) for attaching a rail (2) to a concrete support slab (3*a*) or a concrete sleeper (3*b*) or to a steel structure comprising an intermediate plate (4), a rail attachment plate (5) with angle guide plates (6, 6*b*) arranged thereon, at least two first tensioning clamps (7*a*) for clamping the rail foot (2*a*) to the rail attachment plate (5) as well as screws (9) and/or ankle bolts (10) and at least two second tensioning clamps for screwing the rail attachment system (1) to the underlying surface, characterized in that an elastic intermediate layer (8) is arranged between the rail (2) and the rail attachment plate (5), and the intermediate plate (4) is composed of a highly elastic material and/or comprises a steel plate (4), at least two second tensioning clamps (7*b*) for clamping the rail attachment plate (5) to the substructure, preferably via the intermediate plate (4), wherein the first and second tensioning clamps (7*a*, 7*b*) are embodied in a highly elastic fashion with a high tensioning force, are provided, and at least one upper sliding plate (12) is arranged between the rail foot (2*a*) and a first tensioning clamp (7*a*), and at least one lower sliding plate (13) is arranged between the rail foot (2*a*) and the elastic intermediate layer (8) and is attached by means of a steel support (14) in the case of a steel substructure.

17 Claims, 7 Drawing Sheets

(51) Int. Cl.

| | |
|---|---|
| ***E01B 2/00*** | (2006.01) |
| ***E01B 9/48*** | (2006.01) |
| ***E01B 9/68*** | (2006.01) |
| ***E01B 9/60*** | (2006.01) |

(56) References Cited

U.S. PATENT DOCUMENTS

| | | | | |
|---|---|---|---|---|
| 8,052,068 | B1 * | 11/2011 | Renneckendorf | E01B 9/303 238/310 |
| 8,061,832 | B2 * | 11/2011 | Gorbold | B41J 2/17593 347/100 |
| 8,181,887 | B2 * | 5/2012 | Seifert | E01B 9/681 238/310 |
| 8,602,317 | B2 * | 12/2013 | Bosterling | E01B 9/38 238/312 |
| 9,103,073 | B2 * | 8/2015 | Vorderbruck | E01B 9/303 |
| 2004/0232254 | A1 * | 11/2004 | Kowalski | E01B 3/28 238/264 |
| 2009/0084864 | A1 * | 4/2009 | Bosterling | E01B 9/483 238/349 |
| 2010/0200666 | A1 * | 8/2010 | Bosterling | E01B 9/30 238/310 |
| 2010/0301126 | A1 | 12/2010 | Meyer | |
| 2011/0068185 | A1 * | 3/2011 | Bosterling | E01B 9/38 238/283 |
| 2012/0091216 | A1 * | 4/2012 | Osler | E01B 9/38 238/283 |
| 2012/0181344 | A1 * | 7/2012 | Cox | E01B 9/303 238/351 |
| 2012/0187207 | A1 * | 7/2012 | Cox | E01B 9/685 238/283 |
| 2012/0318881 | A1 * | 12/2012 | Cox | E01B 9/36 238/338 |
| 2013/0206854 | A1 * | 8/2013 | Bosterling | E01B 9/303 238/287 |
| 2014/0374499 | A1 * | 12/2014 | Awi Abalo | E01B 9/681 238/283 |

FOREIGN PATENT DOCUMENTS

| | | | |
|---|---|---|---|
| DE | 19623523 | A | 1/1998 |
| DE | 19825270 | A | 12/1998 |
| JP | 07238501 | A | 9/1995 |

* cited by examiner

Fig. 1 - Prior Art
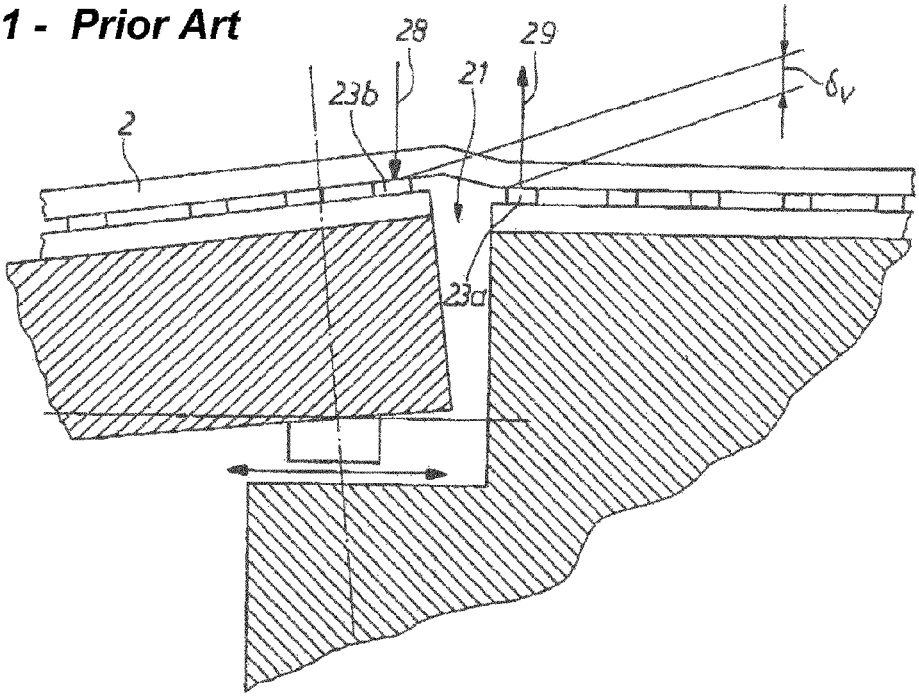
Fig. 2 - Prior Art
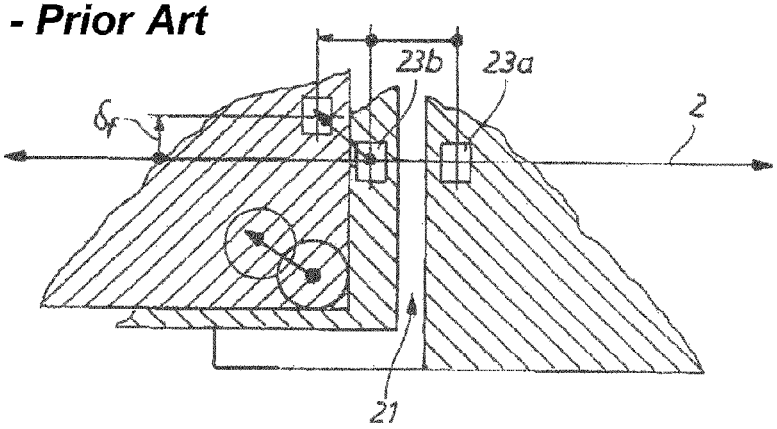

RAIL ATTACHMENT SYSTEM FOR JUNCTION AREAS

CROSS REFERENCE TO RELATED APPLICATIONS

This application is the US-national stage of PCT application PCT/EP2013/065413 filed 22 Jul. 2013 and claiming the priority of German patent application 102012014500.4 itself filed 23 Jul. 2012.

1. FIELD OF THE INVENTION

The invention relates to track fastening assemblies for attaching a rail to a substrate, including an intermediate plate provided on a track supporting layer/concrete slab (fixed rail track) or on a sleeper (track ballast), a track attachment plate carrying angle guides, at least two first spring clips for clamping the rail foot to the rail-attachment plate, and screws and/or anchor bolts for screwing the track-fastening assembly to the track supporting layer or track ballast.

The invention relates in particular to track-fastening assemblies as provided in so-called transition areas between different track beds having different elasticities. Such transition areas are located for instance at the entry to and exit from tunnels, at the ends of bridges, and the like, wherever the type and thus the elasticity of the substrate or subgrade changes and thus when loaded there are height movements in the gravel track ballast, i.e. in the track with the rail.

2. PRIOR ART

In general, the above-described transition areas are found on all railroad tracks, i.e. for instance transitions from bridges to tunnels, bridges to subgrade, subgrade to tunnel, or from bridge segment to bridge segment with intervening pylons.

Due to the different elasticities of the substrate, for instance solid rock in the tunnel, and the relatively soft bridge structure for a reinforced concrete bridge, the gravel track ballast and thus the rails move very intensely in the transition area.

In particular in a fixed rail track, that is, in a rail track without gravel, in which the rail attachments are mounted directly on concrete slabs, significant lifting movements occur in the transition area from bridge to tunnel when the train travels thereover, since in this area the train produces a so-called lifting wave on the tracks. The track-fastening assembly used in this area must therefore be designed such that the lifting wave can be smoothed and such that high lifting forces may be absorbed. Thus both high elasticity and high retaining forces are required for such track-fastening assemblies.

At the same time, the track-fastening assembly must ensure that the creep resistance in the rail longitudinal direction is reduced such that no damaging forces act on the bridge structure or another substrate due to thermal and operation-related longitudinal movements of the rails.

Finally, particularly stringent requirements with respect to lateral elasticity, i.e. elasticity transverse to the rail direction, are also placed on such track-fastening assemblies in order to elastically absorb, and thus limit, elastic absorption of transverse displacements of junction plates and in addition to the expansion joints between individual track supporting layers.

The forces and displacements that occur in such transition areas are shown schematically in FIGS. 1 and 2.

FIG. 1 shows the forces acting on the track-fastening assemblies for the case in which the track 2 bridges a junction between a rail support point 23*a* having a bearing slide plane not inclined with respect to the substrate 26 and an adjacent rail support point 23*b* having a bearing slide plane 25 inclined relative to the substrate 26. A train passing over the rail 2 causes horizontal displacement of the rail 2 by a pressure load on the rail support point 23*b* in the direction of the arrow 28 and a tensile load on the rail support point 23*a* in the direction of the arrow 29. This finally leads to the vertical offset k, of the rail 2 above the joint 21.

FIG. 2 shows the transverse force resulting from this vertical displacement and acting on the bearing 23*b* adjacent the bearing 23*a* above the joint 21, which transverse force causes transverse displacement $\delta_q$ of the bearing 23*b* relative to the bearing 23*a*.

The track-fastening assemblies known to date from practice are not able to satisfy all of the above-described criteria with the result that the lifting action is sufficiently smoothed and longitudinal and transverse displacements may be reliably absorbed without damage by the substrate.

3. OBJECT OF THE INVENTION

An object of the invention is therefore to provide a track-fastening assembly for attaching a rail to a substrate, preferably a substrate having a different elasticity, which track-fastening assembly is able to overcome the disadvantages of the prior art. This object of the invention is attained using a track-fastening assembly that includes the features of claim 1. Advantageous embodiments of the invention are defined in the dependent claims.

4. SUMMARY OF THE INVENTION

According to the invention, the only criteria that must be satisfied in particular in the transition area of track-fastening assemblies are addressed in that an elastic intermediate layer is provided between the rail and the rail-attachment plate, an intermediate plate between rail-attachment plate and concrete slab or height compensation plate comprises a highly elastic material, at least two second spring clips are provided for clamping the rail-attachment plate to the substrate, preferably via the intermediate plate, and the first and second spring clips being highly elastic and exerting a high tensioning force, and at least one upper slide plate is provided between the rail foot and a first spring clip and at least one lower slide plate is provided between the rail foot and the elastic intermediate layer.

The high elasticity of the track-fastening assembly is generated primarily by a highly elastic intermediate plate and/or a steel plate in conjunction with an elastic intermediate layer. The intermediate plate is below the actual rail-attachment plate that itself is retained on the elastic plate with two highly elastic spring clips with simultaneously high tensioning force. The intermediate layer is on the rail-attachment plate below the rail foot. The required deflections (elasticities) are attained with this dual elastic bearing. With local traffic, the required elasticities are about 5-20 kN/mm for fixed rail tracks, and for long distance and cargo traffic, with the associated higher speeds and higher loads, in the range of 20-35 kN/mm for fixed rail tracks. For the particularly stringent requirements in the transition area between two substrates that have different elasticities, track-fastening assemblies with this higher elasticity that simultaneously have high tensioning (high resilience) are required for fixed rails.

A highly elastic intermediate plate having the advantages and features explained in greater detail in the following is preferred. In particular in the transition area where bridges are connected to adjacent substrates, however, a steel plate may also be provided individually or in combination with a highly elastic intermediate plate.

The high retaining forces that are required in the track-fastening assemblies according to the invention are attained using first and second spring clips that clamp the rail foot to the substrate on both sides of the rail. While the first spring clips, preferably exactly two first spring clips, clamp the rail foot directly to the rail-attachment plate via an elastic intermediate layer, the second spring clips, preferably exactly two second spring clips, clamp the rail-attachment plate to the concrete body or another substrate via the highly elastic intermediate plate.

All of the spring clips have the same high tensioning force with simultaneously high elasticity in order to create a secure track-fastening assembly, even for the transition area. Spring clips having a dynamic fatigue strength in the range of 2.5 to 3.5 mm deflection and having a tensioning force of greater than 12 kN, preferably 14-16 kN, are preferred.

The reduced creep resistance in the rail longitudinal direction is attained by using slide plates, for instance made of steel or a high-strength plastic, that are preferably equipped with a slide layer. Such slide layers may be produced for instance substantially from molybdenum. The upper slide plate is between the upper face of the rail foot and the first spring clip, the upper slide plate preferably being designed such that it cannot slip laterally. The preferred slide layer on at least an upper face of the upper slide plate is provided on the upper face of the rail foot.

The lower slide plate, in turn, is between the bottom of the rail foot and an elastic intermediate layer, a slide layer of the lower slide plate preferably being provided on the rail foot in this case as well.

Preferably the end of each spring clip arm is flattened in order to support the spring clip completely on the upper slide plate and in particular to prevent local deformations of the upper slide plate.

Finally, the lateral elasticity, i.e. the elasticity transverse to the longitudinal elongation of the rail, is preferably attained using a plurality of angle guides, preferably four angle guides, made of high-strength and elastic plastic and possibly each having an appropriate ribbed geometry. A high-strength elastic plastic PA 6.6 with a 30% proportion of glass fibers in the matrix is particularly preferred.

Preferably the highly elastic intermediate plate has a stepped elasticity with which the plate reacts relatively gently when a first load is introduced, and thus has a flat spring characteristic, and, when a higher load is introduced, for instance after a deflection of at least 2 mm, has higher elasticity, i.e. a steeper spring characteristic. This type of dual spring characteristic may be attained for instance using steps in a homogeneous elastic material or by providing elevated geometry elements. In one particularly preferred embodiment of the invention, therefore, at least one step in the intermediate plate is embodied with a transition from a thinner area to a thicker area. An embodiment of the highly elastic intermediate plate in which a comparatively thin center area is adjacent two comparatively thick lateral areas is extremely preferred. In accordance with the invention, the differences between the comparatively thin area and the comparatively thick area may be in the range of less than 1 mm.

What this design attains is that when the rails lift, that is, when the rail support point is raised, the elastic plate relaxes but does not lose contact with the actual rail-attachment plate. The track-fastening assembly according to the invention therefore preferably prevents any lifting of components and the formation of gaps between the individual components of the track-fastening assembly.

Moreover, during manufacture of the track-fastening assembly according to the invention preferably other requirements are observed, such as for instance the establishment of a certain electrical resistance. This is attained by providing suitable insulation elements, such as for instance anchor bolts, or the shape and material of the intermediate layer, the intermediate plate, the angle guide, and/or the base plate.

Also, the ability to pre-assemble at least some components of the track-fastening assembly according to the invention is preferred, and may be attained with especially simple means using the suitable geometric configuration in particular of spring clips and angle guides.

In another preferred embodiment of the invention, the track-fastening assembly may have a steel underlayment that replaces the conventional concrete structures with bumps. Using this steel plate variant provides a secure support and attachment structure for the rails, in particular in bridge areas, especially in the area of bridge joints with increased requirements there for vertical force absorption and lateral deformability of the track-fastening assembly. The steel underlayment used for this in accordance with the invention is in principle a plate having end faces where spring clips and/or over-spring clips act against angle guides pressed onto the steel underlayment at support faces that rise from the plate plane and that preferably have the shape of the bumps of concrete sleepers. In one particularly preferred embodiment the rising support faces are pivoted by an angle >45°, preferably of about 60° from the plate plane of the steel underlayments to the rail. Horizontal controllability, preferably on the order of magnitude of up to W±+/−8 mm, may be attained using appropriate adaptation and expansion of the lateral plastic guide elements, so that ultimately a track correction of up to ±16 mm may be attained. Vertical controllability, preferably on an order of magnitude of −4 mm to +26 mm, may preferably be attained by inserting suitable height compensation plates. The steel underlayment plate used according to the invention preferably has a thickness of 16 mm, a maximum vertical height of the steel underlayment surfaces of 25.6 mm being attained at a pivot angle for the support face of 60°. Preferably the length across all of the steel underlayment in standard system is up to 588 mm with width of 230 mm.

Secure anchoring of the track-fastening assembly according to the invention, in particular in concrete substrates or steel constructions, may be assured by using special anchor bolt systems or screw connections.

Height compensation across the width of the track-fastening assembly according to the invention may be attained for instance with particularly simple means using suitable height compensation plates, and possibly also height compensation plates with different thicknesses.

The adjustability of the track-fastening assembly according to the invention is preferably increased using angle guides with different widths.

5. BRIEF DESCRIPTION OF THE DRAWING

The invention is described in greater detail in the following with reference to FIGS. 3 and 9. These figures show examples of preferred embodiments of the invention or of some components of the track-fastening assembly according to the invention.

6. SPECIFIC DESCRIPTION OF PREFERRED EMBODIMENTS

Figure 3:
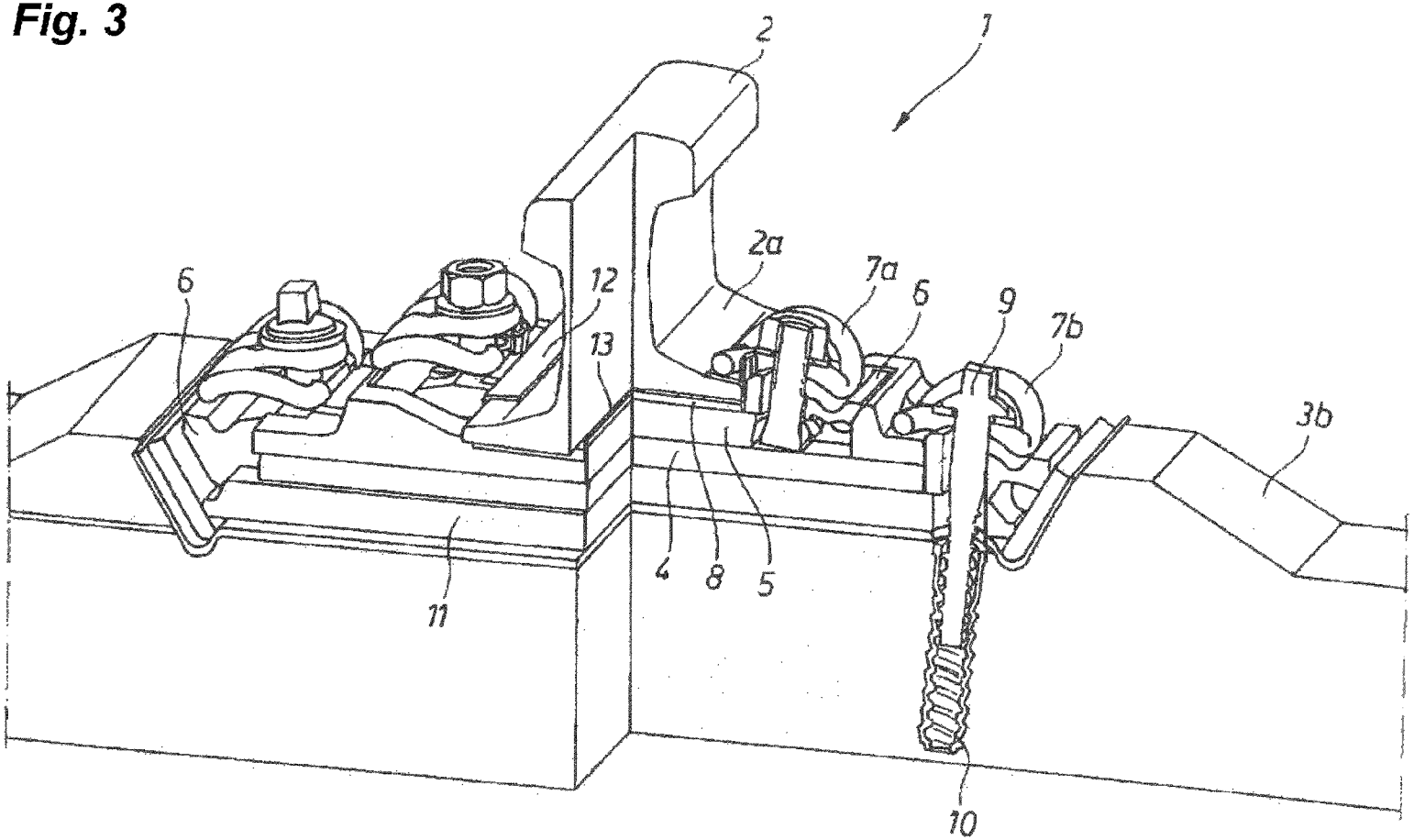
FIG. 3 is a partly sectional view through a track-fastening assembly according to the invention, here with concrete substrates.

FIG. 3 shows a perspective and partly sectional view of a track-fastening assembly 1 via which a rail 2 may be attached to a concrete slab or sleeper 3*b*. The structure of the track-fastening assembly from bottom to top includes a height compensation plate 11 below a highly elastic intermediate plate 4. A height compensation plate is normally only necessary for later position correction after the start of construction or after lengthy use. Above the highly elastic intermediate plate 4 is a rail-attachment plate 5, for instance made of cast steel. Provided between the intermediate plate 5 and the bottom of a rail foot 2*a* is a lower slide plate 13, whose face turned toward the rail foot 2*a* is provided with a slide layer. In addition, an elastic intermediate layer 8 is provided below the lower slide plate 13 and above the rail-attachment plate 5. An upper slide plate 12 is supported on the upper face of the rail foot 2*a* and also has a slide layer on its face turned toward the rail foot 2*a*. First spring clips 7*a* are supported both on the upper slide plate 12 and on respective angle guides 6 and are clamped to the rail-attachment plate 5 via screws. The entire track-fastening assembly 1 is itself screwed to the concrete slab or concrete sleeper 3*b* via two spring clips 7*b* that are supported on respective angle guides 6 *b* via screws 9 and possibly anchor bolts 10.

Figure 4:
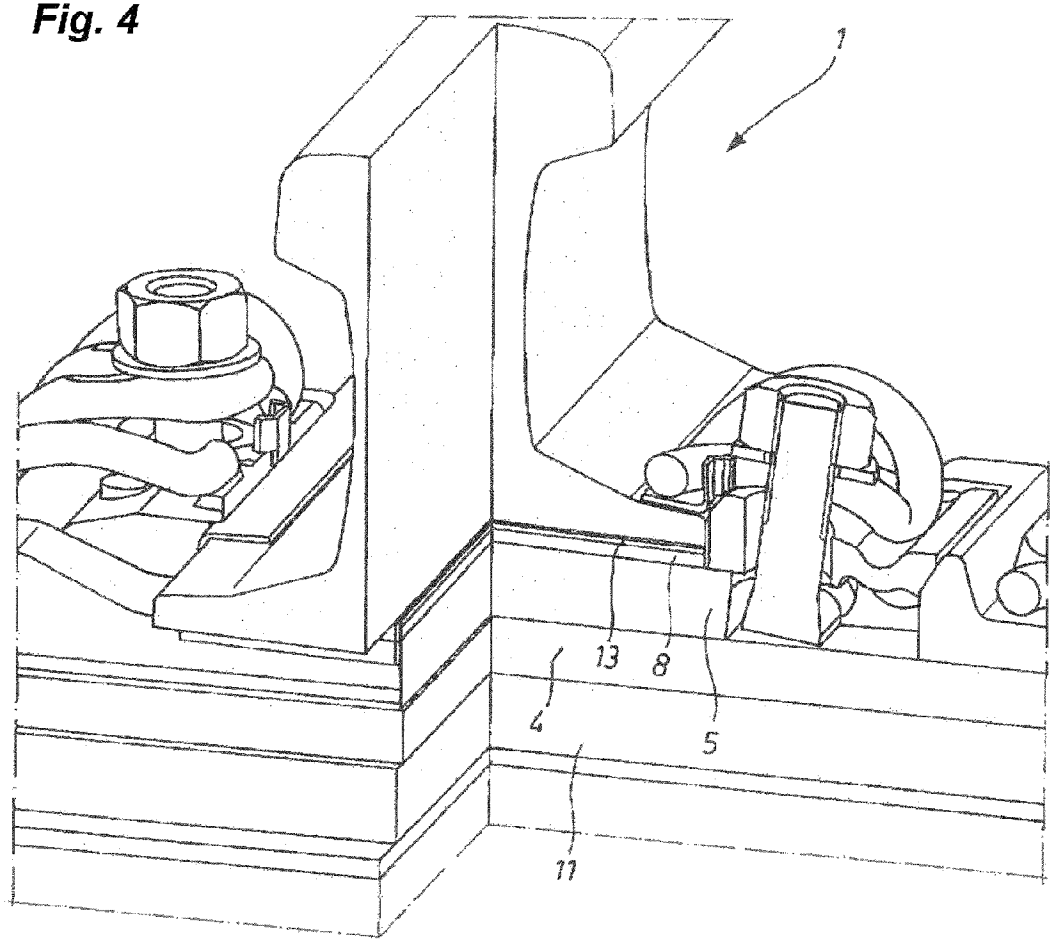
FIG. 4 is a partly sectional view through part of a track-fastening assembly according to the invention.

FIG. 4 shows an enlarged view of part of the track-fastening assembly 1 from FIG. 3 with the layer structure of the track-fastening assembly 1 from bottom to top made of the height compensation plate 11, the intermediate plate 4, the rail-attachment plate 5, and the intermediate layer 8 provided thereover between the rail-attachment plate 5 and the lower slide plate 13.

Figure 5:
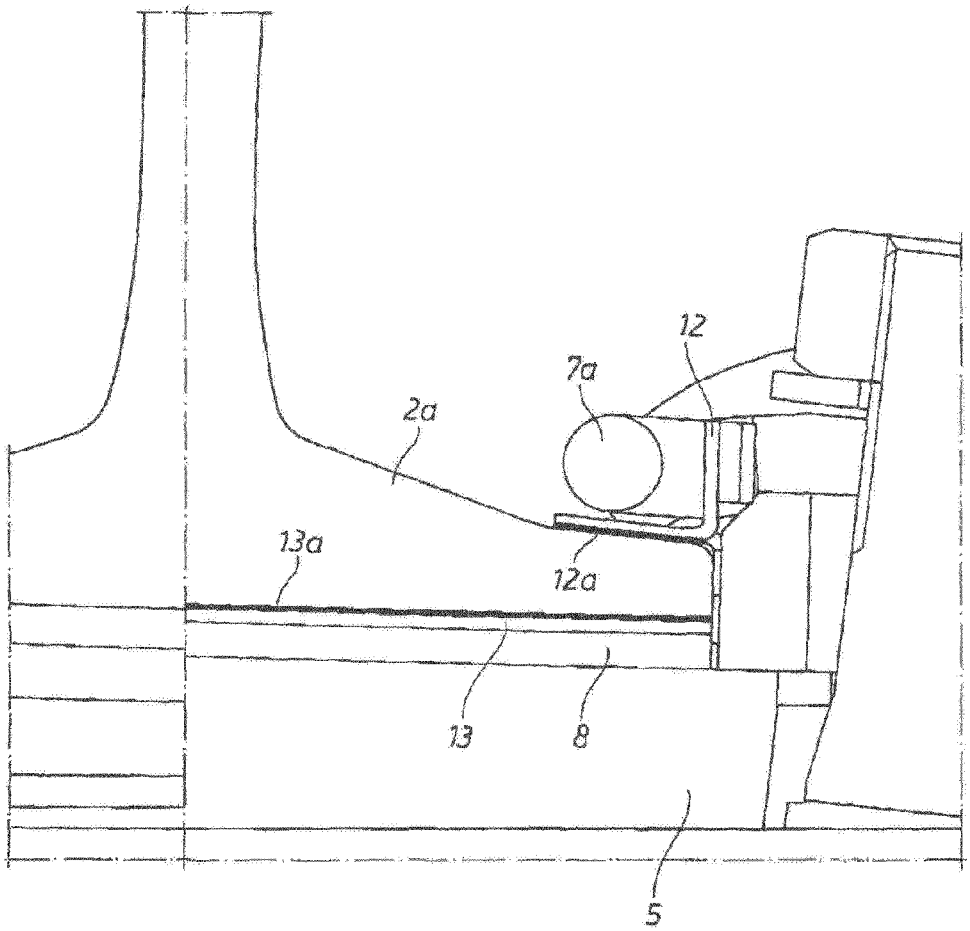
FIG. 5 is a sectional view through part of a track-fastening assembly according to the invention.

FIG. 5 shows a sectional and enlarged view of part of the rail foot 2*a* that is secured at part of its upper face to the rail-attachment plate 5 by an upper slide plate 12 via the spring clip 7*a*. The lower slide plate 13 having a slide layer 13*a* (enlarged for the purposes of illustration) is provided between the intermediate layer 8 and the bottom of the rail foot 2*a*. Analogously, its lower face turned toward the rail foot 2*a* the upper slide plate 12 is provided with a slide layer 12*a*.

Figure 6:
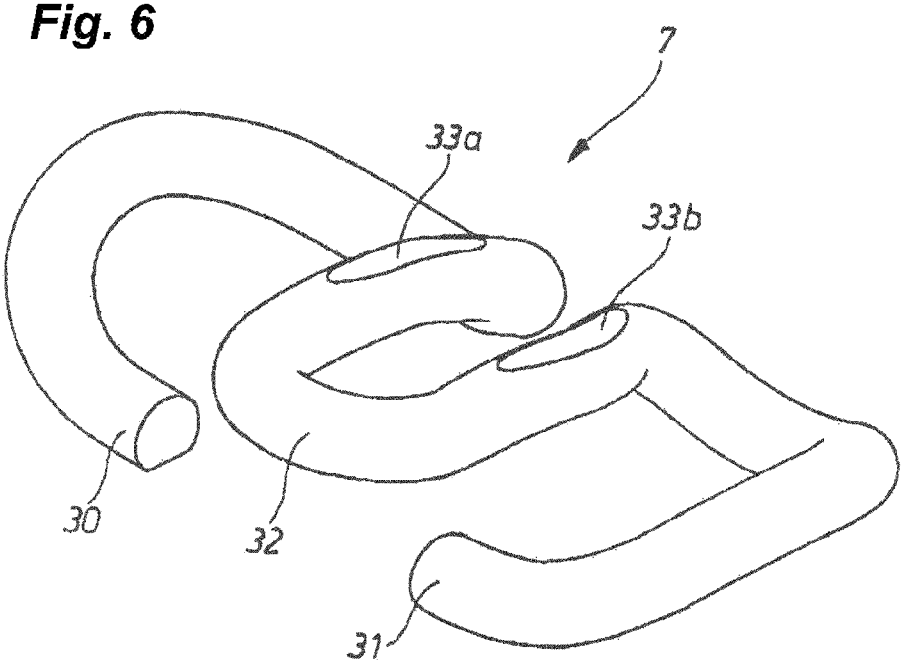
FIG. 6 is a perspective view of a spring clip from above.

FIG. 6 shows a perspective view of a spring clip 7 as preferably used in the track-fastening assemblies according to the invention. The spring clip 7 has two ends 30 and 31 directed toward one another, and an arcuate middle loop 32. Two flats 33*a*, 33*b* are added to the upper face of the center loop 32 in order to permit greater surface area contact between the spring clip 7 and a tensioning screw (not shown).

Figure 7:
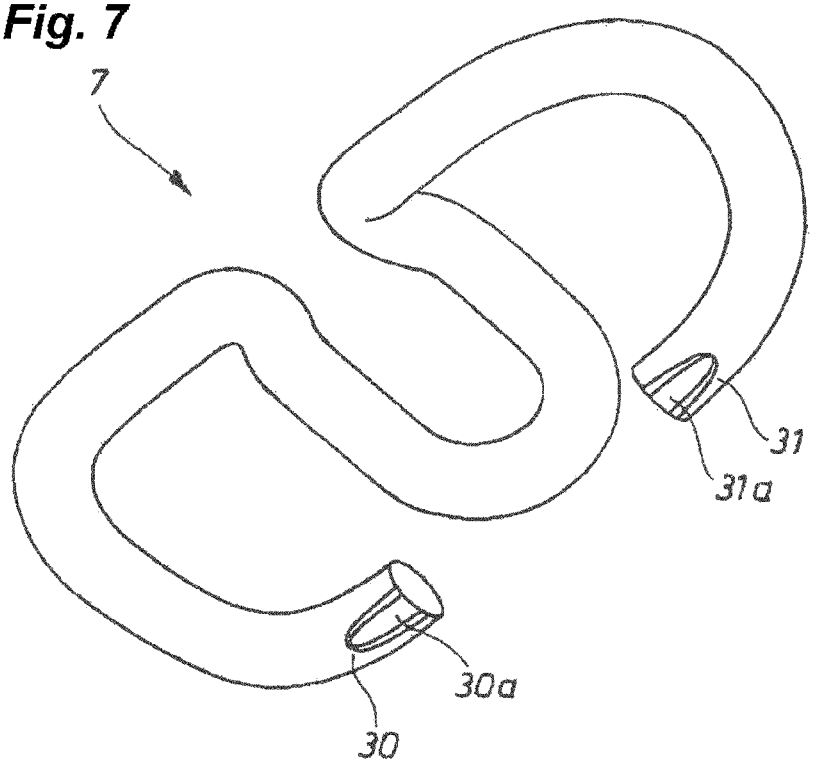
FIG. 7 is a perspective view of a spring clip from below.

FIG. 7 shows the bottom of a spring clip 7, preferably for use in a track-fastening assembly according to the invention. Flats 30*a* and 31*a* are formed on the bottom sides of the free ends 30 and 31 of the spring clip 7 to provide greater surface area contact between the spring clip 7 and the upper slide plate (not shown).

Figure 8:
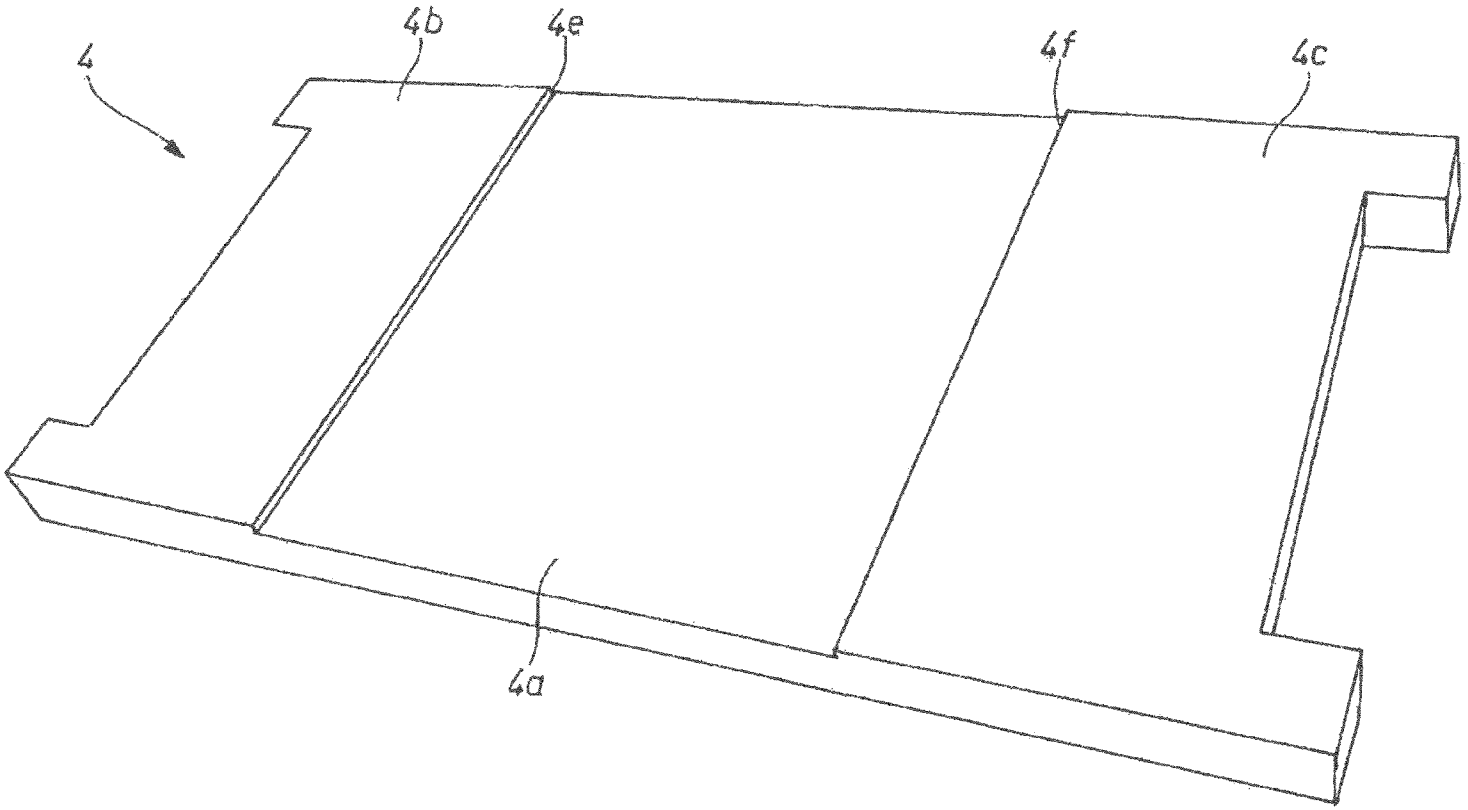
FIG. 8 is a perspective view of an intermediate plate as part of a track-fastening assembly according to the invention.

FIG. 8 is a perspective view of the highly elastic intermediate plate 4 as preferably used in one embodiment of the track-fastening assembly according to the invention. The intermediate plate 4 is thinner in a center area 4*a* where the foot (not shown) of the rail sits, than in the side areas 4*b* and 4*c*. The transitions from the lateral areas 4*b*, 4*c* to the center area 4*a* are steps 4*e* and 4*f*. An intermediate plate 4 that has a dual spring characteristic may be obtained solely via its geometric configuration, but preferably also in combination with a suitable material selection or a suitable material compound, it being particularly preferable when first a gentle and then a hard resistance to deformation of the intermediate plate 4 is imparted regardless of the deflection.

Figure 9:
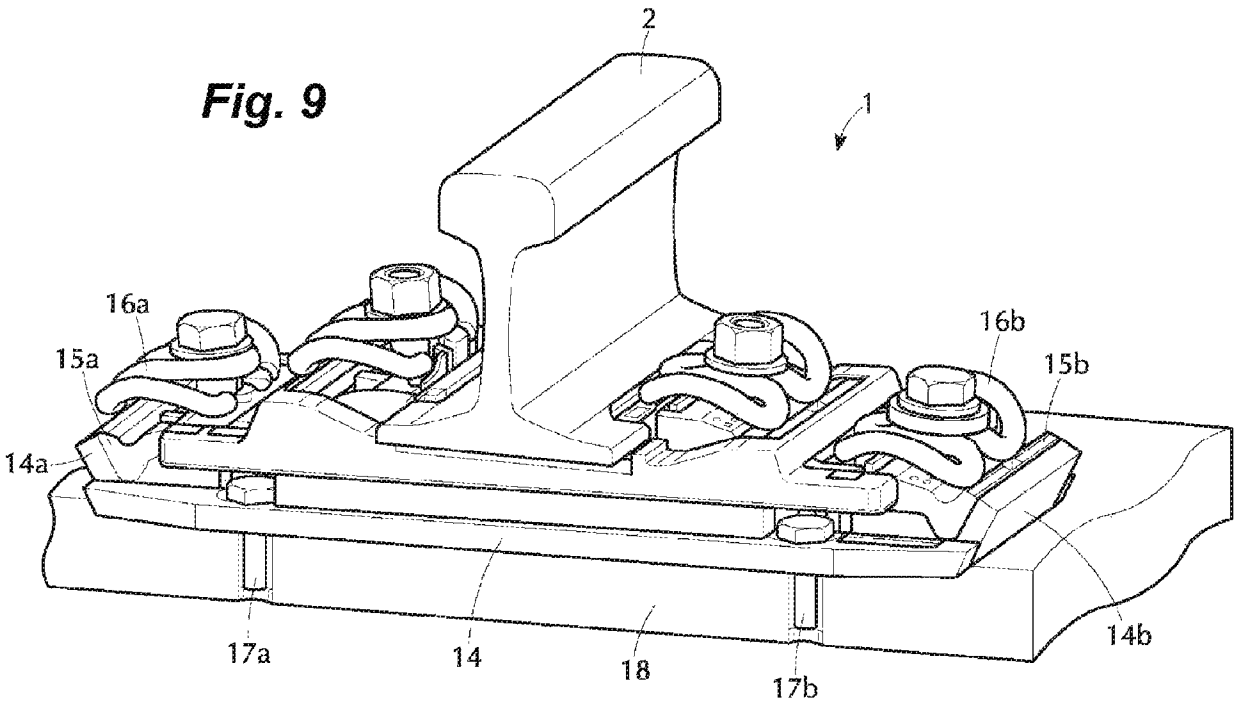
FIG. 9 is a perspective view of a further embodiment of the track-fastening assembly according to the invention for steel structures.

Finally, FIG. 9 shows another embodiment of a track-fastening assembly 1 according to the invention for steel plates/steel construction substrate in which the angle guides 15*a* and 15*b* of the outer spring clips 16*a* and 16*b* of the track-fastening assembly are supported against support faces 14*a* and 14*b* at the end faces of a steel underlayment 14. The spring clips 16*a* and 16*b* are joined to the steel underlayment 14 via screws, preferably metric screws. The steel underlayment 14, with the support faces 14*a* and 14*b* that in the embodiment shown here are pivoted upward from the plate plane of the steel underlayment 14 toward the rail 2 by an angle of 60°, thus replaces the concrete structures (not shown) as underlayment with normally integrated humps (not shown) against which the angle guides 15*a*, 15*b* lean when clamped. The steel underlayment 14 is preferably screwed directly to a steel structure 18 via screws 17*a* and 17*b* with a metric thread. In one likewise preferred variant not shown in FIG. 9 the steel underlayment 14 is mounted directly on a flat concrete slab, for instance by a screw-anchor bolt combination (not shown), in is particular a screw-anchor bolt combination having a metal or plastic anchor bolt.

The invention claimed is:

1. A track-fastening assembly for attaching a rail to a substrate formed by a concrete support slab, a concrete sleeper, or a steel underlayment, the assembly comprising:

an intermediate plate formed of highly elastic material or steel;

a rail-attachment plate provided with angle guides;

at least two first spring clips for clamping a rail foot to the rail-attachment plate;

first and second anchors formed by screws or bolts, the first anchors being seated in the rail-attachment plate and holding down the first spring clips;

an elastic intermediate layer between the rail and the rail-attachment plate;

at least two second spring clips attached by the second anchors to the substrate and clamping the rail-attachment plate to the substrate via the intermediate plate, the first and second spring clips being highly elastic and exerting a high tension force;

at least one upper slide plate between the rail foot and a first spring clip; and at least one lower slide plate between the rail foot and the elastic intermediate layer.

2. The track-fastening assembly according to claim 1, wherein the assembly is provided in so-called transition areas between different track beds having different elasticities.

3. The track-fastening assembly according claim 1, wherein the elastic intermediate layer has a stiffness of 55-65 kN/mm.

4. The track-fastening assembly according to claim 1, further comprising:

a height compensation plate between the concrete slab, enhancement plate, fixed rail track, or the substrate and the intermediate plate.

5. The track-fastening assembly according to claim 1, wherein the transition area is between a fixed rail track in a tunnel and a fixed rail track of a concrete girder bridge or between a fixed rail track and a track ballast subgrade or between steel structures.

6. The track-fastening assembly according to claim 1, wherein the elastic intermediate plate has a spring characteristic that is stepped as a function of deflection, first gentler and then harder.

7. The track-fastening assembly according to claim 1, wherein the first and second spring clips have dynamic fatigue strength in the range of 2.5 to 3.5 mm deflection and have a tensioning force of greater than 12 kN.

8. The track-fastening assembly according to claim 1, wherein the upper or lower slide plate has means for preventing slip.

9. The track-fastening assembly according to claim 1, wherein ends of the first or second spring clips are flattened.

10. The track-fastening assembly according to claim 1, wherein the angle guides are made of highly elastic polyamide 6.6 with 30% glass fiber.

11. The track-fastening assembly claim 1, wherein the angle guides have a rib structure for increasing elasticity.

12. The track-fastening assembly claim 1, wherein the intermediate plate has a cross-sectional shape formed with at least one step.

13. The track-fastening assembly according to claim 1, wherein the intermediate plate is made of microcellular polyurethane or microcellular synthetic rubber with stepped elasticity.

14. The track-fastening assembly according to claim 1, wherein the assembly has high elasticity of 20 to 35 kN/mm with simultaneous high retaining force of up to 30 kN.

15. The track-fastening assembly according to claim 1, wherein the steel underlayment is a plate and has at the end faces thereof support faces that project from the plate plane, for the angle guides and/or the spring clips.

16. The track-fastening assembly according to claim 15, wherein the support faces are pivoted toward the rail out of the plate plane of the steel underlayment about an angle >45°.

17. A track-fastening assembly for attaching a rail to a substrate formed by a concrete support slab, a concrete sleeper, or a steel underlayment, the assembly comprising:

an intermediate plate formed of highly elastic material or steel having a stiffness of 55-65 kN/mm;

a rail-attachment plate provided with angle guides;

at least two first spring clips for clamping a rail foot to the rail-attachment plate;

first and second anchors formed by screws or bolts, the first anchors being seated in the rail-attachment plate and holding down the first spring clips;

an elastic intermediate layer between the rail and the rail-attachment plate;

at least two second spring clips attached by the second anchors to the substrate and clamping the rail-attachment plate to the substrate via the intermediate plate, the first and second spring clips being highly elastic and exerting a high tension force of greater than 12 kN;

at least one upper slide plate between the rail foot and a first spring clip; and at least one lower slide plate between the rail foot and the elastic intermediate layer, the slide plates being constructed to reduce longitudinal resistance to creep of the rail.

* * * * *